United States Patent [19]

Wallace

[11] 4,139,448

[45] Feb. 13, 1979

[54] SEPARATING WEB - ELECTROLYTIC COMPARTMENT FRAMES ASSEMBLY FOR ELECTROLYTIC APPARATUSES

[75] Inventor: Bruce S. Wallace, Grand Island, N.Y.

[73] Assignee: Hooker Chemicals & Plastics Corp., Niagara Falls, N.Y.

[21] Appl. No.: 866,423

[22] Filed: Jan. 3, 1978

[51] Int. Cl.[2] ..... C25B 1/16; C25B 1/26; C25B 9/00; C25B 9/04

[52] U.S. Cl. ..... 204/256; 204/258; 204/266; 204/279; 204/290 F; 204/286; 204/284

[58] Field of Search ..... 204/256, 258, 266, 279, 204/290 F, 286, 284

[56] References Cited

U.S. PATENT DOCUMENTS

| | | | |
|---|---|---|---|
| 3,684,670 | 8/1972 | Raetzsch | 204/266 X |
| 3,775,272 | 11/1973 | Danna | 204/266 X |
| 3,778,362 | 12/1973 | Wiechers et al. | 204/256 X |
| 3,836,448 | 9/1974 | Bouy et al. | 204/256 X |
| 3,864,236 | 2/1975 | Lindstrom | 204/266 X |
| 3,875,040 | 4/1975 | Weltin et al. | 204/256 X |
| 3,884,781 | 5/1975 | Bouy et al. | 204/279 X |
| 3,930,151 | 12/1975 | Shibata et al. | 204/266 X |
| 4,026,782 | 5/1977 | Bouy et al. | 204/279 X |
| 4,057,479 | 11/1977 | Campbell | 204/266 X |
| 4,078,987 | 3/1978 | Specht | 204/266 |

*Primary Examiner*—Arthur C. Prescott
*Attorney, Agent, or Firm*—Peter F. Casella; Howard M. Ellis

[57] ABSTRACT

An assembly of electrolyte compartment frames and a separating web for a filter press type of bipolar electrolytic apparatus includes gasketing material between the frames and the web near the ends of the web and a recess in such frames at an end of the web so that when the web differentially expands with respect to the electrolyte compartment frames it may move past the gasketing material and into the recess, thereby preventing distortion of the web and the frames and maintaining a liquid-tight seal between them.

14 Claims, 3 Drawing Figures

SEPARATING WEB - ELECTROLYTIC COMPARTMENT FRAMES ASSEMBLY FOR ELECTROLYTIC APPARATUSES

This invention relates to an assembly of components for use in electrolytic apparatuses. More particularly, it relates to a combination of electrolytic compartment frames for use in a filter press type of electrolytic apparatus with a separating web between them to provide a liquid-tight and gas-tight wall between anolyte and catholyte compartments of an electrolytic apparatus.

Electrolytic apparatuses incorporating cells containing bipolar electrodes are useful for the manufacture of various chemical materials, including chlorine, caustic and chlorate, and are well known. It is also known to make such cells of a filter press assembly type, wherein a plurality of them is held together by longitudinally compressive forces like those applied at the ends of a filter press. In such bipolar apparatuses electric current is passed from an anode through the electrolyte to a cathode and then from such cathode to an adjacent anode and such operation is repeated throughout the length of the apparatus. It is important that each cell be physically separate from the next so that electrolytic fluids in them will not be transferred between them. In recent years, rather than to employ steel and mastic as materials of construction for electrolytic cell body and wall parts, synthetic organic polymeric materials have been substituted, such as filled polypropylene.

Use of synthetic organic polymeric materials, such as polypropylene, allows the molding and extrusion of electrolyte compartment frames and other cell parts and accordingly permits the manufacture by comparatively inexpensive methods of bipolar electrolytic apparatuses, preferably of the filter press type. Also, because of the generally good resistance of polypropylene and equivalent and similar moldable polymeric materials to various types of electrolytes, such as hydrochloric acid, brine, aqueous caustic solutions and aqueous chlorine solutions, such frames resist chemical attack during use. However, applicant has found that they do possess disadvantages which are desirably corrected. With the present state of knowledge in the art it is very difficult to accurately mold larger electrolyte compartment frames which incorporate separating webs. Also, due to the different thicknesses of the materials involved it has been found that areas of strain exist where they join and because such strains even vary between different molded articles from the same mold, modifications of mold designs do not readily solve the problem. Furthermore, also as a result of the different thicknesses of the frame and separating web materials where they join in an integral structure, during heating and cooling of an electrolytic cell the differential expansion experienced (with the thinner part being heated or cooled more rapidly than the thicker part) creates strains which, especially in larger pieces, can cause minor distortions and inefficiency of cell operation at best and warping, cracking and fractures of parts thereof, with attendant undesired reactions and leakage of electrolyte, at worst. The described objections to integrally molded large electrolyte compartment frames and separating webs have been overcome by the present invention. It permits the use of a separate separating web, which obviates molding problems due to increasing the sizes of the structures involved to produce electrolytic cells of greater capacities and at the same time eliminates strains at points of connection or joinder of the web and frames. Also, strains are not created in the described structures because of expansions of some of the parts thereof, especially differential expansions upon heating and cooling of the electrolytic apparatus. U.S. patent application Ser. No. 680,611, filed Apr. 26, 1976 by Eng et al. describes a filter press cell wherein the electrolyte compartment frames have a "separator" molded integrally with them. U.S. Pat. No. 3,778,362, like Ser. No. 680,611, previously referred to, describes synthetic organic polymeric materials, such as polypropylene, used as a material of construction for electrolyte compartment frames. U.S. Pat. No. 4,059,216 describes metallic separators inside bipolar electrodes. Yet, none of such patents addresses itself to the solving of the problem confronting the present applicant and none discloses, teaches or suggests his solution.

In accordance with the present invention an assembly of electrolyte compartment frames and a separating web for an electrolytic apparatus comprises an anolyte compartment frame, a catholyte compartment frame and a separating web between them to prevent passage of electrolyte between such compartments, which separating web is capable of being held by pressure in liquid-tight relationship to the anolyte compartment and catholyte compartment frames while being movable between them to compensate for expansion and contraction of the web without distortion of the web and without loss of liquid-tight separation of the anolyte and catholyte compartments by the web. In preferred embodiments of the invention the electrodes are bipolar, the apparatus is for the electrolysis of brine or hydrochloric acid, preferably brine, the electrolyte compartment frames are of synthetic organic polymeric material, preferably asbestos or glass fiber-filled polypropylene, the separating web is of similar material, although metal webs may also be employed, the separating web is held in liquid-tight and gas-tight relationship with the electrolyte compartment frames, as in a sandwich, with gasketing between it and the frames, allowing longitudinal movement of the web, and recesses are provided at the web ends to allow expansion of the web into such recesses upon heating of the cell and thereby to prevent strains that could be caused by having such expansion occur against an abutting or restraining portion of an electrolyte compartment frame. Particularly preferred embodiments of the invention will be described further in this specification.

The invention will be readily understood by reference to the specification, taken in conjunction with the drawing, in which.

Figure 1:
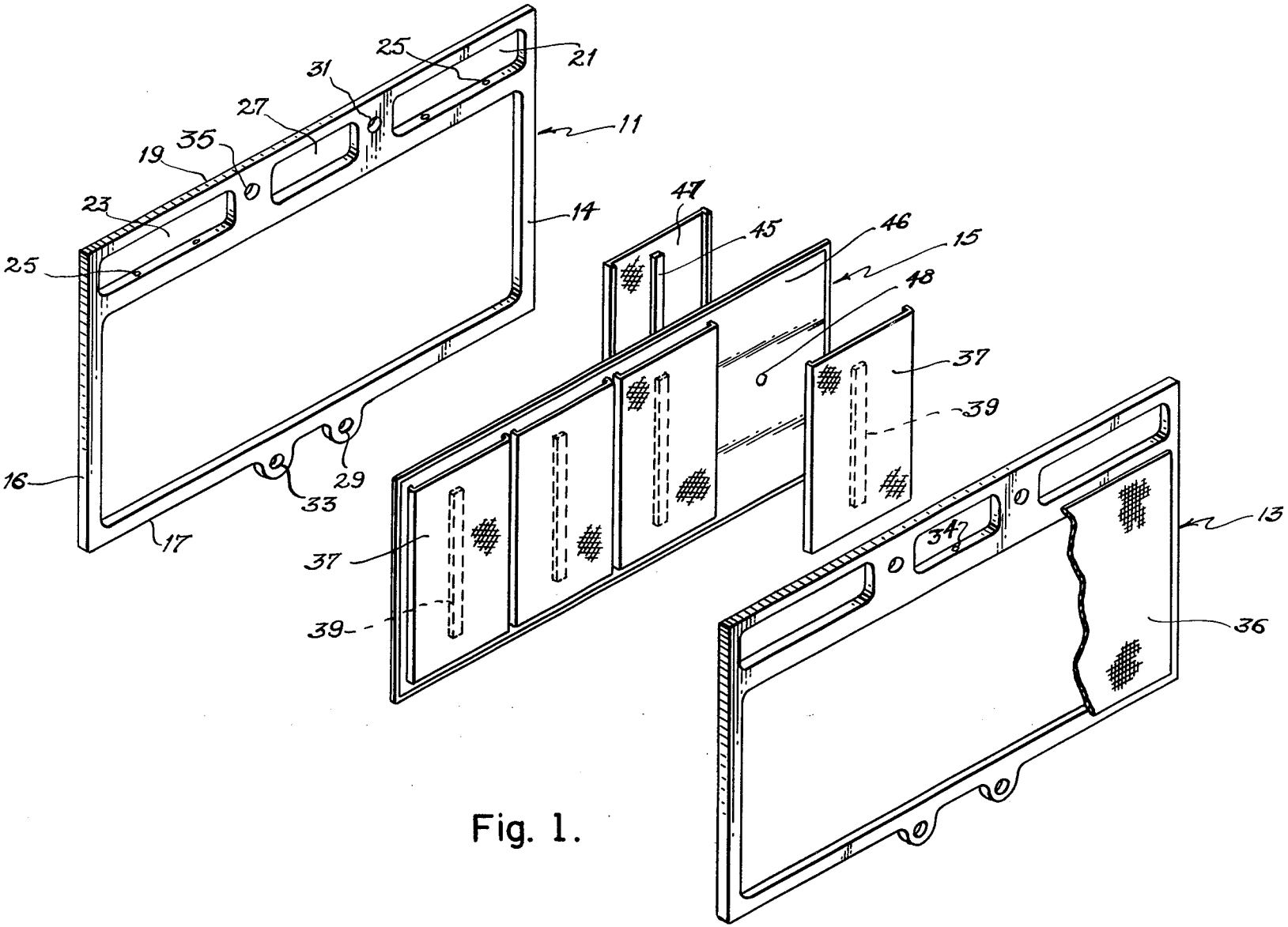
FIG. 1 is a partially disassembled view of a pair of electrolytic compartment frames and an intermediate web assembly, showing various electrolytic cell parts held to the web and a frame.

In FIG. 1 anolyte compartment frame 11 and catholyte compartment frame 13 are shown, for clarity of representation, separated from intermediate web assembly 15. Anolyte compartment frame 11 includes framing walls 14 and 16, bottom framing portion 17 and top framing portion 19, all of which combine to form the generally rectangularly shaped framing structure of member 11. Internal header openings 21 and 23 are for gaseous products of electrolysis generated at the anode and such gas passes through openings 25 from the anolyte compartment section below to the headers, which are formed by the walls about such openings. Header opening 27 is for gas which may be generated at the cathode. Thus, in a cell for the electrolysis of brine, headers 21 and 23 are for chlorine and header 27 is for hydrogen. Additionally, headers 21 and 23 are for anolyte liquid and header 27 is for caustic solution. Drains 29 and 33 are for brine and caustic, respectively and inlets 31 and 35 are for brine and caustic solution feeds. Compressive forces are applied to the frames and intermediate webs, as by tightening of threaded nuts (not shown) onto threaded ends of tightening rods or bolts (not shown), so as to tightly press a series of electrolyte compartment framing members together. Catholyte compartment framing member 13, as illustrated, is clearly of a structure similar to that of anolyte compartment frame 11 and accordingly the parts thereof need not be further described except for mention of passage 34 for the removal of gas generated at the cathode from said cathode area to header passageway or opening 27. Ion exchange membrane 36 is held to the catholyte compartment frame 13 by suitable means (not shown), but may be held to the "far" side (that away from the viewer) of the anolyte compartment frame 11 instead. It is continuous and a single and unitary membrane, such as one of fluorinated polymeric plastic of the ion exchange type, e.g., Nafion, mfd. by E.I. DuPont de Nemours & Co., Inc., covers the frame and overlies all four (or other number, e.g., 1–8) cathodes. The ion exchange membrane may sometimes be replaced with a suitable semipermeable membrane or diaphragm.

Figure 2:
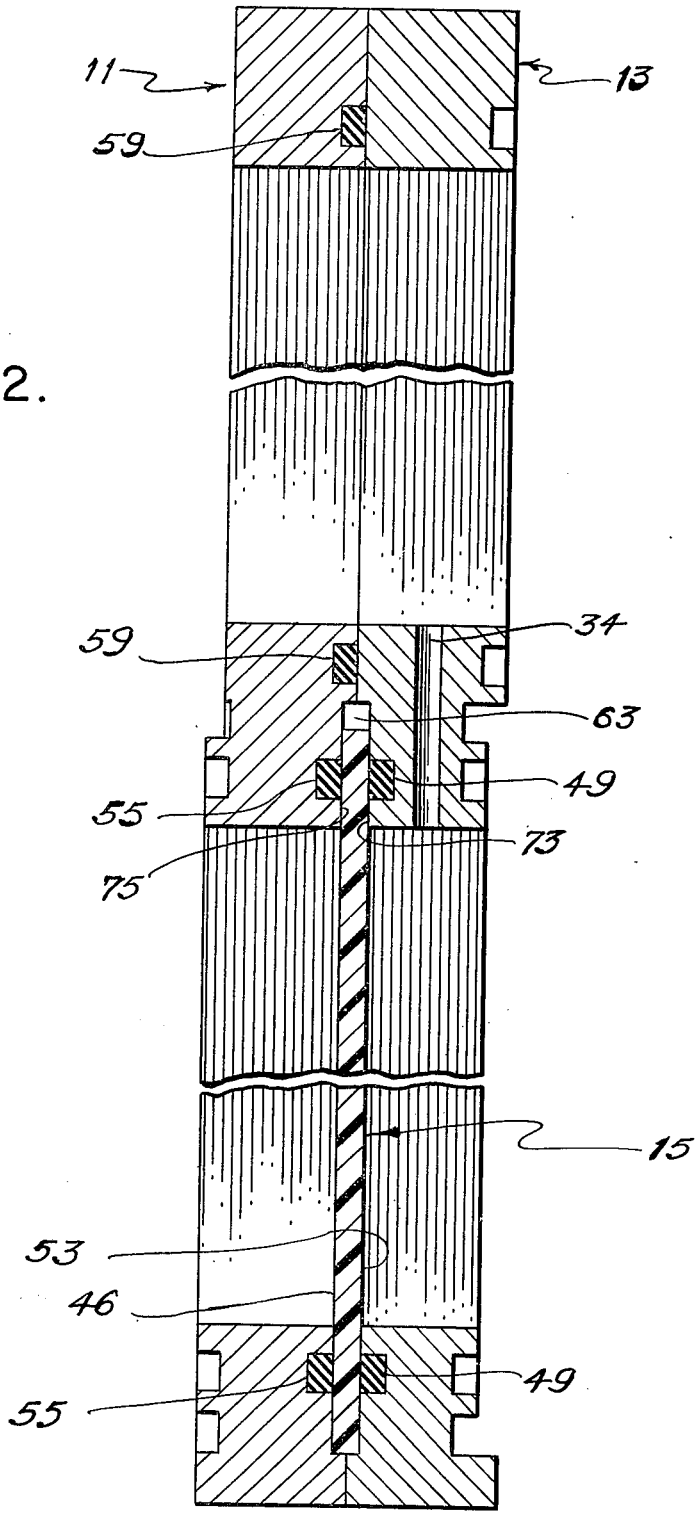
FIG. 2 is a vertical sectional view of the assembly of frames and separator of FIG. 1, omitting electrodes, conductor bars and membrane.

Web assembly 15 includes web 46 which is mountable in sandwiched relationship between frames 11 and 13, as is illustrated in more detail in FIG. 2. The cathode screens 37, as illustrated, being four separate screens, each fastened to a cathode conductor bar 39, are each essentially rectangular in shape with sides being formed or bent so as to extend from the major surface of the cathode screen toward the web (although such parts do not normally contact it). The tops and bottoms of such screens may be similarly formed. Cathode conductor bars 39 are joined to cathode screens 37 by suitable conductive welding or other conductive joinders and to intermediate conductive sections, not illustrated in FIG. 1 but shown in FIG. 3, by bolt or other fastening means. Anode conductor bar 45 and anode screen 47 are viewable where moved away from the web, as is passageway 48 through web 46 where cathode screen 37 and conductor bar 39 are similarly moved. Various modifications of the structure shown in FIG. 1 may be made. For example, single anode and cathode screens may be employed instead of the eight (four each) electrode screens illustrated. Different methods of joinder of the conductor bars to the electrodes may be utilized and such bars and the electrode, frames and webs may be of other shapes, structures and designs. For example, the conductor bars may be externally connected to other such bars (cathode bar to anode bar) externally, obviating the need for conduction via a conductor passing through the separator. FIG. 1 does not show all the details of the framing members and web because it is considered that most of these will be evident to those of skill in the art and relate primarily to fitting together and sealing of various cell parts and not to the primary aspects of the present invention. Thus, showing them in detail might tend to obfuscate rather than clarify the invention. Omitted parts which are relevant to the invention will be described more completely with reference to FIGS. 2 and 3. Thus, gasketings, ledges, recesses, bolts, collars, etc., are not shown.

In FIG. 2, the structure illustrated has been shortened as indicated by discontinuity symbols, so as to be able to utilize a more illustrative drawing to show the main parts of the present invention. As is seen from the drawing, web assembly 15, shown primarily as web 46, is sandwiched between anolyte compartment frame 11 and catholyte compartment frame 13. Resilient gasket 49, which fits into a continuous accommodating recess (not numbered) in the catholyte compartment frame and "encircles" the web 46, normally projects beyond such recess but, as illustrated in the assembly of the catholyte compartment frame, web and anolyte compartment frame shown, illustrated under compressive force, it is substantially flattened and contacts the major face 53 of web 46 over substantially the entire width of the accommodating recess when in sealed, fluid-tight relationship with the frame and web. A matching gasket is provided in a similarly accommodating recess in the anolyte compartment frame 11. Thus, gasket 55 also holds the web 46 in liquid-tight and fluid-tight contact with anolyte compartment frame 11. Additionally, gasket 59, in an accommodating recess in the anolyte compartment frame, prevents escape of gaseous products of electrolysis from the gas headers. Although the various gaskets and recesses are illustrated somewhat conventionally as being generally rectangular in cross-section various other suitable shapes may also be employed so as to obtain improved sealing effects.

In the assemblies illustrated the electrolyte compartment frames measure approximately 1.5 by 2.7 meters, with the longest axis being horizontal but with one of the two major axes being vertical (the axis of thickness is also horizontal). For simplicity of illustration, although a similar recess or a pair of recesses is also provided at a vertical end or at such ends of the web, such a recess is illustrated in FIG. 2 at the top of the web. Recess 63 has top and side wall portions adjacent the catholyte compartment frame and the corresponding portions in the anolyte compartment frame, forming recesses in such frames. Also, walls 73 and 75 are walls of corresponding recesses in the mentioned frames to accommodate web 46. Although recess 63 is illustrated at the top of the web 46 a corresponding recess may also be and is sometimes provided adjacent the bottom of such web so as to allow expansion of the web in both directions without strain on the assembly. However, it has been found that provision of the recess or room for expansion at the top only is suitable for assemblies of the size and character herein described and often, due to its weight, the web will settle to the bottom.

Figure 3:
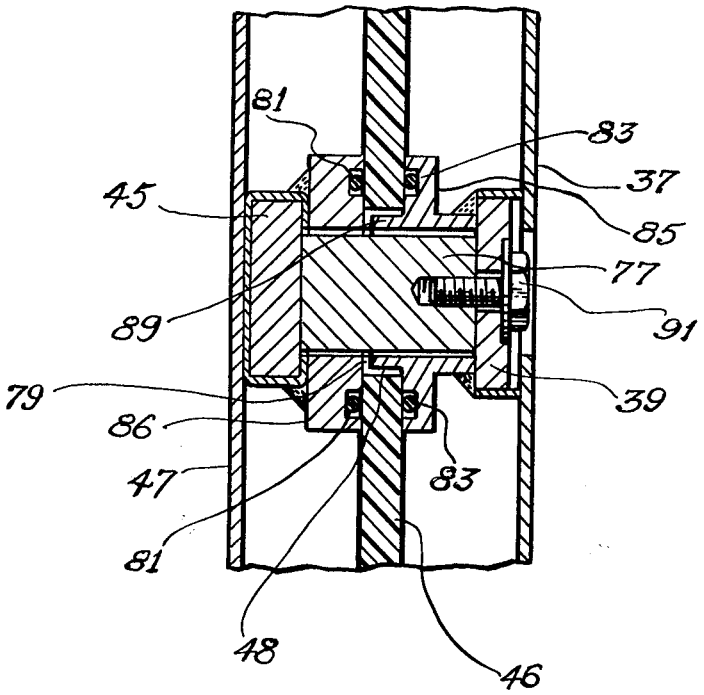
FIG. 3 is a horizontal section of part of the assembly of FIG. 1, illustrating means for conducting electricity between electrodes of different cells.

It will be noted that the passageway through the web separator is not shown in FIG. 2 and neither is the conductive means for in-cell conduction of electricity from the cathode of a bipolar electrode to the anode of the next. Such parts are illustrated in FIG. 3 and may be considered to be inserted at the bottom "break" line of FIG. 2. Also, FIG. 2 may be considered to omit such conductive means.

In FIG. 3 cathode 37, suitably fastened, as by welding, to cathode conductor bar 39, has electrical current communicated from it through the conductor bar 39 and intermediate conductive material 77, which may be joined to cathode conductor bar 39 or to anode conductor bar 45, to anode 47. Although it is highly desirable for the conduction of the electrical current to be essentially perfect, with little or essentially no resistance, it is also important that there should be no transfer of liquid or gas from one electrolyte compartment to another. For this reason opening 48 in web 46 (which allows passage of the conductor from cathode to anode) is sealed off by ring gaskets 81 and 83, contained in accommodating recesses in collars 86 and 85, the former being joined to anode conductor bar 45. It will be seen that the clearance space 79 between such collar-shaped members in passage 48 allows for tightening of the parts thereof by bolt 91 without causing strains due to movements of one part against another and yet ledge portion 89 helps to position collar 85 with respect to web 46.

The anolyte compartment frames and catholyte compartment frames of this invention may be of various sizes but the invention is most useful with respect to larger such frames which are difficult or impossible to make with a separating web molded therein. Generally it is very difficult or presently impossible to accomplish such molding when the overall nominal surface area (of one major surface, considered as the area of a plane generally parallel to such surface) is at least 1.6 square meters and the height and width of such frame are each at least one meter. The thicknesses of such frames may vary, even over the length of a single frame, but are usually in the range of 2 to 8 cm. While the materials of construction of the frames may be selected for the particular electrolytic process to be employed and for compatibility with the electrolyte and products of electrolysis, normally the synthetic organic polymeric materials, commonly referred to as plastics, will be most useful. Both thermoplastics (of sufficiently high softening points) and thermosetting plastics may be employed. For example, poly-lower alkylenes, such as polypropylene, polyethylene, polyethylene-polypropylene and poly(ethylene-propylene) are presently considered to be most preferred but in appropriate circumstances polyesters, polyethers, phenolic polymers, polyurethanes, polyacetals, those polymers generally referred to as engineering plastics, fluorinated and perfluorinated poly-lower alkylenes, polyvinyl halides, such as polyvinyl chloride and other such materials, in filled or unfilled states or as coatings over base materials may be utilized. Preferred fillers include glass fibers (preferably of lengths from 0.1 cm. to 1 cm.), chopped glass fibers, asbestos, mica, talc, silica, and various other compatible fillers known to the art, which often contribute rigidity and other desirable physical and chemical properties to the frames. The presently most preferred materials, glass fiber- and asbestos-filled polypropylenes, contain from about 10 to 50% of filler material (mixtures of fillers may also be employed) and have desirable physical properties, in addition to being chemically resistant to most electrolytes, including brine at both acidic and alkaline pH's and with chlorine dissolved therein.

The preferred webs of this invention are also of synthetic organic polymeric material, most preferably filled polypropylene of the types described for the frames but the other mentioned polymers may also be employed. The polypropylene and others of the synthetic organic polymeric materials cooperate with the elastomeric gasketing materials normally utilized, to form excellent seals, through which the expanding or differentially expanding web may move without loss of sealing contact. In addition to employing solid synthetic organic polymer webs there may also be employed hollow webs and hollow webs filled with other plastics, such as materials which would normally react with the electrolyte or products of electrolysis. For example, for rigidification, polystyrene, polycarbonate and polyester materials may be inside a polypropylene or other suitable polymeric outer "skin" so as to give the web rigidity without sacrificing chemical resistance to the environment in which it is employed. Such inner material may be in solid form, corrugated, foamed or of other suitable structure. Although polymeric webs are often preferable it is also within this invention to substitute metallic webs for them. Such webs, when employed in electrolytic cells for the electrolysis of brine or hydrochloric acid solutions, will normally be titanium, titanium alloy or be coated with such material on the side facing the anolyte compartment and may be of a similar material for the side facing the catholyte compartment when hydrogen chloride is being electrolyzed but will preferably be steel for the electrolysis of brine. When the metal webs are used they will preferably include an inner passageway or a chamber between the major surface walls so that nascent hydrogen which may pass through the steel side, when steel is present, may be converted to molecular hydrogen to avoid peeling problems and titanium embrittlement due to the formation of titanium hydride. As will be described in more detail later, when metallic webs are employed conductor materials for conducting electricity through the web may be suitably modified for best results.

The web, when plastic, is preferably in flat extruded or sheet form (although various other shapes may also be employed). In accordance with this invention it is of an area (nominal considering one major surface only) of 1.5 to 10 square meters, preferably 2 to 5 square meters and is of a thickness of 0.5 to 2.5 cm., preferably 1 to 2 cm., with a height of 1 to 4 meters, preferably 1 to 2 meters and a width of 1 to 4 meters, preferably 2 to 3 meters. Of course, it fits in and is accommodated by the electrolyte compartment frames, previously described. The web is preferably located in recesses of equal depths in both the anolyte compartment frame and the catholyte compartment frame but the recess may be primarily or entirely in one frame or the other, providing that the gasketing or sealing effects obtained are satisfactory. The clearance or recess for longitudinal (either vertical or horizontal) expansion of the web should be sufficient to accommodate the differential expansion obtained. Thus, recesses of 0.5 to 5 cm. total are useful, normally being 0.5 to 2 cm. total for vertical expansion and 1 to 5 cm. for horizontal expansion. Preferably, for horizontal expansion, the recesses are in the electrolyte compartment frames adjacent the vertical ends of the web and are equal at both such ends.

Metal webs are of the same dimensions, essentially, and may be of various metals. For example, the web illustrated in FIG. 3 may be replaced with one, in which an anode side of titanium clad copper is employed and the cathode side is of steel. Such webs are described in greater detail in my application for patent entitled Separating Web for Electrolytic Apparatus, to be filed together with the present application.

The gasketing materials used are preferably elastomeric synthetic organic polymers but various other suitable substances may also be employed. Thus, at present the preferred gasketing material is EPDM but neoprene, silicone rubbers, polyurethanes and various other types of known gasketing elastomers and other materials may also be utilized. Generally these are in continuous "ring" or other suitable pre-shaped form to be accommodated by the appropriate recesses in the apparatus parts but it is also possible to utilize straight lengths of gasketing material and to have them inserted, preferably overlapping or of matching shapes at the ends thereof, in appropriate grooves or recesses in the various apparatus parts.

The electrode conductors are chosen of suitable electrolyte-resistant materials which are satisfactorily electrically conductive. Thus, the cathode conductor bar may be of copper suitably joined to the normally steel cathode screen, as by welding. The anode conductor bar is preferably of titanium covered or clad copper. Such materials are considered to be best for utilization in apparatuses for the electrolysis of brine but may be varied for uses in other cells, as will be known in the art. The intermediate conductive material between such conductor bars and any bolting materials present will also preferably be copper, which may be titanium covered or clad on its external cylindrical surface. The collars about such conductor, which are employed to assist in sealing off the opening in the web for passage of the conductor, may be of any suitable material, including plastics, in particular circumstances, but may preferably be titanium on the anode side and soft steel on the cathode side. The tightening bolt will preferably be beryllium copper or stainless steel.

While various anodes and cathodes may be utilized it is preferred to employ dimensionally stable anodes, most preferably ruthenium oxide or other suitable noble metal or noble metal oxide on titanium or other suitable valve metal, e.g., tantalum, and to utilize steel for the cathode. Preferably, both electrodes will be in mesh form but they also may be continuous, perforated and of other types. Ion exchanging or semi-permeable membranes or diaphragms may be used near the cathode to prevent caustic produced from migrating through the electrolyte and reacting with chlorine and preferably such will be an ion exchange membrane and will be of a perfluorinated polymeric material, such as a polytetrafluoroethylene derivative, e.g., that sold by E.I. DuPont de Nemours and Company, Inc., under the trade name Nafion.

The described invention results in separating web-electrolyte compartment frames assemblies which are liquid-tight and are preferably liquid-tight and gas-tight, too. Because of the non-integral construction of the web and the frames and because of the allowance of expansion into the described recess in the presence of tightly fitting gasketing materials, differential expansion on heating and cooling of the electrolytic apparatus does not result in excessive strains which could distort or destroy the assembly. The thin, substantially flat web is easily and cheaply manufactured so the present installations may be made more economically than those in which it is intended to mold the web integrally with a frame, at least for those assemblies for installation in larger electrolytic apparatuses.

The apparatus illustrated in the accompanying figures, with an internal conductor similar to that shown in FIG. 3 being employed to transmit electricity between electrode "pairs", has been manufactured and tested. A two-cell unit equipped with steel cathodes and dimensionally stable anodes has been operated over a four-month period, utilizing a 25% brine solution to generate chlorine, hydrogen and cell liquor containing 200 grams per liter of sodium hydroxide. The semi-permeable membrane employed is DuPont Nafion and the unit operated at an efficiency of 75 to 80%, at 8,000 amperes and eight volts. Conduction of electricity from an "upstream" cathode to a downstream anode was with a minimal voltage drop and the neoprene and EPDM elastomeric gasketing utilized satisfactorily maintains sealing contact with the asbestos-filled polypropylene web and frames. Replacement of the plastic web with a metallic web, having titanium on one side and steel on the other, will result in the same satisfactory sealing, also without any undue straining of the web due to differential expansions and contractions with respect to the frames, caused by temperature changes. Also, when the conduction of electricity is over the electrolyte frames and web instead of through the web similar cell operating characteristics result. In constructing the present cells the web assemblies may be pre-assembled and installed between the frames, one of which may have an ion exchange or other suitable membrane preassembled with it.

In this specification and in the claims all the parts are by weight and all temperatures are in ° C. unless otherwise indicated.

The invention has been described with respect to various illustrations and embodiments thereof but is not to be limited to these because it is evident that one of skill in the art with the present specification before him will be able to utilize substitutes and equivalents without departing from the spirit of the invention.

What is claimed is:

1. An assembly of electrolyte compartment frames and a separating web for an electrolytic apparatus which comprises an anolyte compartment frame, a catholyte compartment frame and a separating web between them to prevent passage of electrolyte between such compartments, which separating web is capable of being held by pressure in liquid-tight relationship to the anolyte compartment and catholyte compartment frames while being movable between them to compensate for expansion and contraction of the web without distortion of the web and without loss of liquid-tight separation of the anolyte and catholyte compartments by the web.

2. An assembly according to claim 1 wherein the electrolytic apparatus is for the electrolysis of brine or hydrochloric acid, the electrodes are bipolar, the separating web is of synthetic organic polymeric material, the electrolyte compartment frames are of synthetic organic polymeric material, separable from and non-integral with the web, the separating web is capable of being held in a filter press type of assembly in liquid-tight and gas-tight relationship to the electrolyte compartment frames and the web is movable between the frames to compensate for differential expansion and contraction of the web with respect to such frames without distortion of the web and without loss of liquid-tight and gas-tight separation of the anolyte and catholyte compartments by the web.

3. An assembly according to claim 2 wherein the apparatus is for the electrolysis of brine, the separating web is thin and substantially flat and is positioned with one of its major axes substantially vertical, the web and the electrolyte compartment frames are suitable for installation in a filter press type electrolytic apparatus wherein the electrolyte compartment frames are pressed together against each other and the web, gasketing means are located between the electrolyte compartment frames and the web to provide liquid-tight and gas-tight seals between them, while permitting expansion of the web, and at least one of the electrolyte compartment frames includes a recess to accommodate such expansion.

4. An assembly according to claim 3 wherein the web is in sheet form, is of an area of 1.5 to 10 square meters and is of a thickness of 0.5 to 2.5 cm., a height of 1 to 4 meters and a width of 1 to 4 meters, the electrolyte compartment frames each include recesses for the web and for its expansion and the web is located substantially centrally between the electrolyte compartment frames and in the recesses for it and is positioned so that it may expand into the recesses for such expansion.

5. An assembly according to claim 4 wherein the electrolyte compartment frames include gasketing means at the peripheries thereof and at the periphery of the web and may be held together with the web sandwiched between them, in liquid-tight and gas-tight relationship by application of a longitudinal compressive force against them pressing them together and against the intermediate gasketing means.

6. An assembly according to claim 5 wherein conductor means are provided passing through and sealed in liquid-tight and gas-tight relationship with the web for conducting electricity from a cathode, which is attachable to the catholyte compartment frame, to an anode, which is attachable to the anolyte compartment frame.

7. An assembly according to claim 6 wherein the anode and cathode are installed, the anode is a dimensionally stable anode and the cathode is of steel, the anode is attached to an anode conductor of titanium clad copper, the cathode is attached to a cathode conductor of copper and the anode conductor and cathode conductor are bolted together through the web and gasketed to prevent passage of liquid and gas past the web.

8. An assembly according to claim 7 wherein the gasketing material is EPDM.

9. An assembly according to claim 1 wherein the separating web is of filled polypropylene.

10. An assembly according to claim 9 wherein the compartment frames are of filled polypropylene.

11. An assembly according to claim 8 wherein the web and compartment frames are of filled polypropylene.

12. An assembly according to claim 1 wherein the apparatus is for the electrolysis of brine or hydrochloric acid, the electrodes are bipolar, the separating web is of metallic material(s) resistant to an electrolyte with which it is intended to be in contact and the electrolyte compartment frames are of synthetic organic polymeric material and are separable from the web.

13. An assembly according to claim 12 wherein the apparatus is for the electrolysis of brine, the electrolyte compartment frames are of filled synthetic organic polymeric material and the separating web is of titanium on the side facing the anolyte compartment frame and of steel on the side facing the catholyte compartment frame.

14. An assembly according to claim 13 wherein the separating web is thin and substantially flat, of a thickness of 0.5 to 2.5 cm., a height of 1 to 4 meters, a width of 1 to 4 meters and of an area of 1.5 to 10 square meters, one of the major axes thereof is substantially vertical, the web and the electrolyte compartment frames are suitable for installation in a filter press type electrolytic apparatus wherein the electrolyte compartment frames are pressed together against each other and the web, gasketing means are located between the electrolyte compartment frames and the web to provide liquid-tight and gas-tight seals between them, while permitting expansion of the web, and at least one of the electrolyte compartment frames includes a recess to accommodate such expansion.

* * * * *